US007934507B2

(12) United States Patent
Brooks

(10) Patent No.: US 7,934,507 B2
(45) Date of Patent: May 3, 2011

(54) POST-CESAREAN SECTION SCAR MANAGEMENT UNDERGARMENT

(76) Inventor: Catherine Brooks, Solana Beach, CA (US)

( * ) Notice: Subject to any disclaimer, the term of this patent is extended or adjusted under 35 U.S.C. 154(b) by 276 days.

(21) Appl. No.: 11/243,062

(22) Filed: Oct. 4, 2005

(65) Prior Publication Data

US 2007/0077860 A1 Apr. 5, 2007

(51) Int. Cl.

| | |
|---|---|
| ***A61F 5/37*** | (2006.01) |
| ***A61F 13/00*** | (2006.01) |
| ***A61F 7/00*** | (2006.01) |
| ***A41D 10/00*** | (2006.01) |

(52) U.S. Cl. ..... 128/873; 602/43; 602/67; 450/155; 2/114; 607/96

(58) Field of Classification Search ..... 128/98.1, 128/873; 450/155, 94, 122, 114, 115; 424/402, 424/401, 78.03, 78.05, 78.06, 78.07, 817, 424/887, 400; 602/43, 2, 7, 14, 42.51, 19, 602/67; 607/96, 114, 108–112; 2/114, 464, 2/465

See application file for complete search history.

(56) References Cited

U.S. PATENT DOCUMENTS

| | | | | |
|---|---|---|---|---|
| 2,015,255 | A * | 9/1935 | Charpier et al. | 602/61 |
| 3,310,053 | A * | 3/1967 | Greenwood | 450/153 |
| 3,817,245 | A | 6/1974 | Kroeger | |
| 3,871,367 | A | 3/1975 | Miller | |
| 3,909,847 | A | 10/1975 | Holt et al. | |
| 4,155,360 | A | 5/1979 | Erickson | |
| 5,103,505 | A | 4/1992 | Liorens | |
| 5,406,964 | A | 4/1995 | Calleja | |
| 5,538,500 | A * | 7/1996 | Peterson | 602/48 |
| 6,062,946 | A * | 5/2000 | Rosenberg | 450/155 |
| 6,282,729 | B1 | 9/2001 | Oikawa et al. | |
| 6,308,341 | B1 | 10/2001 | Shelton | |
| 6,736,141 | B2 | 5/2004 | Freedman | |
| 2001/0036791 | A1 | 11/2001 | Smith | |
| 2003/0100856 | A1 | 5/2003 | Engelbert | |
| 2004/0055075 | A1 | 3/2004 | Sullivan-West | |
| 2004/0118412 | A1 * | 6/2004 | Piletti-Reyes | 128/876 |
| 2005/0014451 | A1 | 1/2005 | Wicks | |
| 2006/0281391 | A1 * | 12/2006 | Martz | 450/94 |

OTHER PUBLICATIONS

Print out of term DUODERM in trademark is attached.*

Carr-Collins, J. "Pressure Techniques for the Prevention of Hypertrophic Scar", Clin Plast Surg. Jul. 1992;19(3):733-43.

(Continued)

*Primary Examiner* — Patricia M Bianco
*Assistant Examiner* — Tarla R Patel
(74) *Attorney, Agent, or Firm* — McNair Law Firm, P.A.; Seann P. Lahey

(57) ABSTRACT

The present invention comprises a modified woman's undergarment that includes a peri-pubic light compression panel allowing for compression at the incision site and a treatment dressing means for exposing the wound to a medicament. The combination of light compression and treatment with applicable medicament functions to minimize the formation of scars following cesarean section incisions performed in the lower transverse uterine or peri-pubic area. Considering the long phase of wound healing, this design flexibility allows for the use of the garment under a variety of street clothes. Unlike a girdle or abdominal support device, the crux of the invention does not require heavy or high abdominal support, although for those applications requiring girdle-type support, the invention could also be fabricated in a style that allows abdominal support along with the focused incision peri-pubic compression and incision care.

5 Claims, 2 Drawing Sheets

OTHER PUBLICATIONS

De-Oliveira, G. V. et al. "Silicone versus Nonsilicone Gel Dressings: A Controlled Trial." Dermatol Surg. Aug. 2001;27(8):721-6.

Ehrlich, H.P. et al. "Regulation of Wound Healing from a Connective Tissue Perspective." Wound Repair Regener. 1996;4:203-10.

Gold, M.H. et al. Prevention of Hypertrophic Scars and Keloids by the Prophylactic Use of Topical Silicone . . . Dematol Surg. Jul. 2001;27(7):641-4.

Ladin, D.A. et al. "Excessive Scarring as a Consequence of Healing." Wound Repair Regener. 1995;3:6-14.

Suetake, T. et al. "Effects of Silicone Gel Sheeting on the Stratum Corneum Hydration." British Jrnl Plas Surg. 2000;53:503-7.

Van Der Kerckhove, E. et al. "Silicones in the Rehabilitation of Burns: A Review and Overview." Burns May 2001;27(3):205-14.

* cited by examiner

FIG. 1
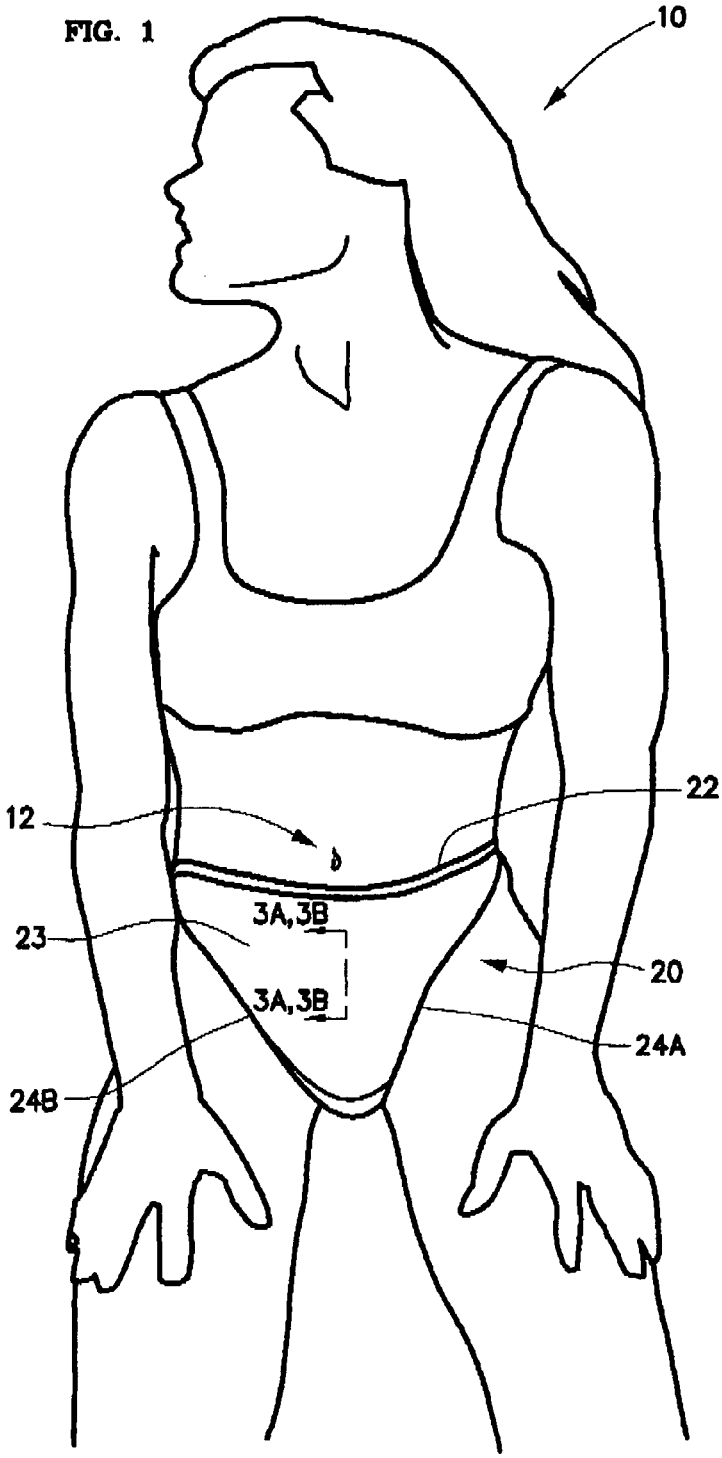
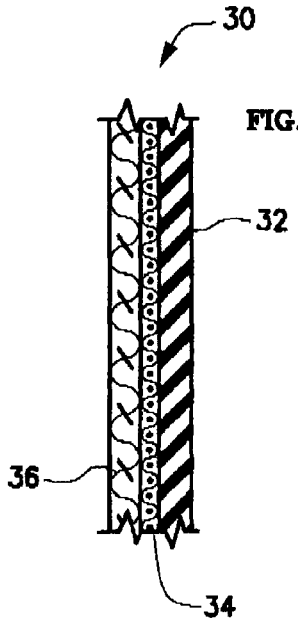
FIG. 3A
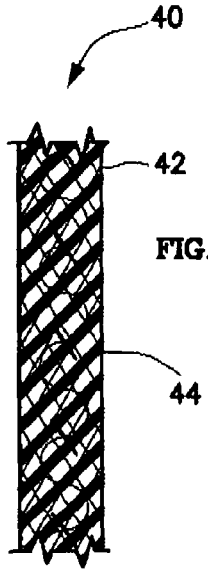
FIG. 3B

FIG. 2
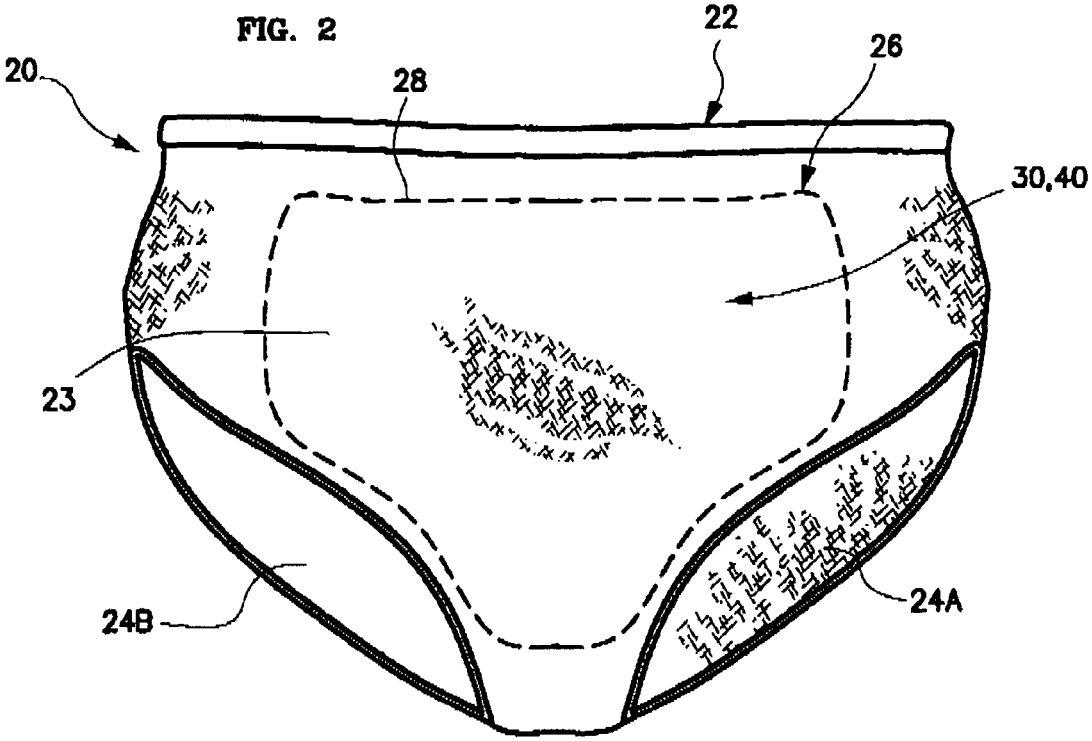
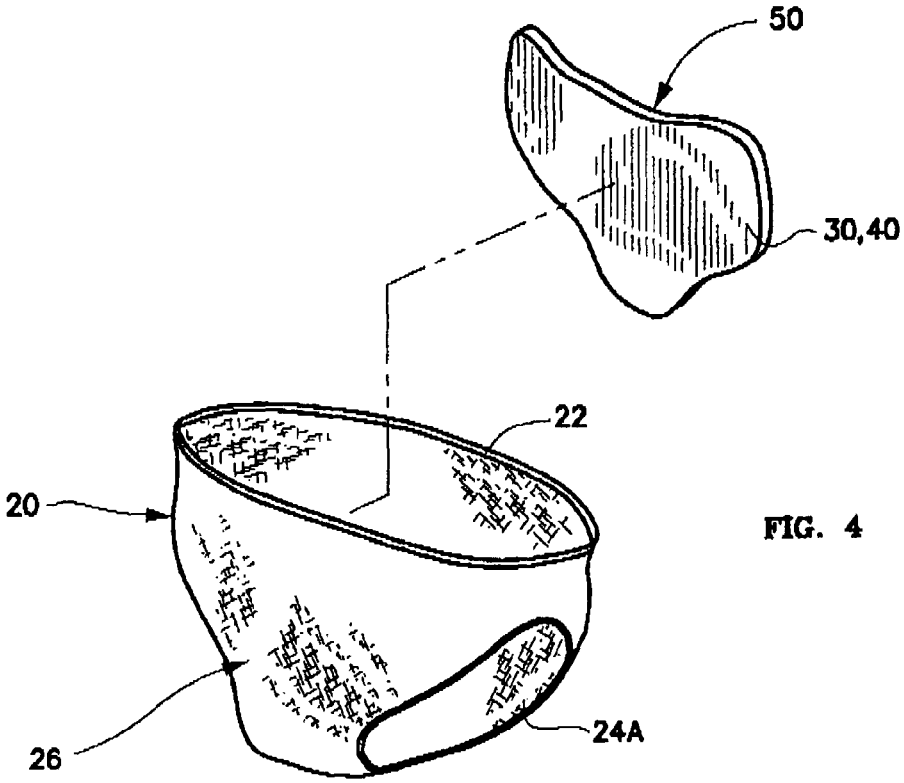
FIG. 4

POST-CESAREAN SECTION SCAR MANAGEMENT UNDERGARMENT

FIELD OF THE INVENTION

The present invention combines the fields of rehabilitation (wound care and scar management), post-partum care and everyday apparel. More specifically, the present invention comprises a women's undergarment that integrates peri-pubic cesarean incision site compression as well as medicament scar management to minimize scar formation.

BACKGROUND OF THE INVENTION

According to data generated by the Center of Disease Control in 2005, as found in the center for disease control website (www.cdc.gov/nchs/fastats/delivery.htm) approximately twenty-five percent of live births are reported to be cesarean sections. This data results in over 600,000 U.S. women incurring a cesarean section scar each year. The predominant surgical approach for a cesarean section is a lower transverse uterine incision, resulting in a "bikini line" incision and scar of four to eight inches in length in the peri-pubic area.

Scar tissue is the known result of the human body's healing process. This process is relatively well understood and broken down into three general phases; 1) inflammatory phase where blood flow changes and phagocytosis occur, 2) proliferative phase where tissue granulation and wound closure occur and 3) maturation or remodeling phase where new collagen formation. The three phases combined are considered to last up to or may even be longer than two years. The end result of the healing process is closed and sealed skin at the incision site which functions to resist infections and provide protection for the deeper tissues. Unfortunately, this end result generally forms a visible scar which is considered aesthetically undesirable to many individuals. Scars are also known to be unlike normal skin tissue and have the concerns of hypersensitivity, erythema (redness) and pruritus (itching) as well as the cosmetic concerns of being bulky and raised.

As discussed in sufficient detail in the medical journal Burns "Silicones in the Rehabilitation of Burns; a Review and Overview, 2001 (27); 205-214, the treatment of scars has long been considered a factor in burn rehabilitation and that specialty has been at the forefront of techniques to understand and ameliorate the condition of scar tissue.

Non-invasive treatment of scarring in burn rehabilitation largely comprises the techniques of pressure and application of medicament (e.g. silicone) dressings. Pressure is thought to influence the "organization" of the newly deposited collagen fibers as well as decrease tension on the wound by displacing it to the periphery of the compression. Pressure, as used in the remediation of burn and hand scarring, is often applied by custom-made elastic garments. Silicone, or occlusive dressings, control the moisture content of the developing scar tissue and also apply pressure and decrease wound tension. Along with the usual and preferred silicone medicaments, other occlusive or semi-occlusive medicament dressings that control scar moisture have also been mentioned in the literature. These two techniques are used either in conjunction or alone extensively in burn rehabilitation. The specialties of reconstructive surgery, especially on the hands and face, and dermatology have incorporated the use of these post-burn techniques into treatment modalities as well as explored their efficacy as demonstrated in the literature, for example, in the journal Clinical Plastic Surgery, Pressure Techniques for the Prevention of Hypertrophic Scar, 1992, July; 19(3):733-743 and the journal Dermatology Surgery, Silicone Gel Sheeting for the Prevention and Management of Evolving Hypertrophic and Keloid Scars, 1995, November; 21(11):947-951. As demonstrated in the literature, the use of compression and silicone or occlusive dressing is well documented to improve scar hypersensitivity, color, pruritus, size, volume and density.

There currently is no product that integrates the use of scar management techniques for the cesarean incision site. There is also no undergarment that utilizes purely peri-pubic compression designed to specifically address cesarean incisions and other low transverse incisions.

SUMMARY OF THE INVENTION

The present invention incorporates the well-proven techniques of scar management into an undergarment in order to promote the favorable maturation of a cesarean sections or low transverse incisions which form scars. In optimal use, the wearer utilizes the undergarment with the combined compression and silicone gel sheeting panel. The undergarment is designed to be worn in lieu of regular underwear in everyday use.

The foundation for the invention uses the parallel of a women's undergarment or underpants. The undergarment or underpants are modified, however, to have a peri-pubic light compression panel allowing for compression at the incision site. It is contemplated by the Applicant that the present invention can be used in various formats and there the underpants is not limited in style and can include but is not limited to being fabricated as a bikini, thong, low-rise, support style, full or high cut underpants. Considering the long phase of wound healing, this design flexibility allows for the use of the garment under a variety of street clothes that can be worn by the individual everyday. Unlike a girdle or abdominal support device, the crux of the invention does not require heavy or high abdominal support, although for those applications requiring girdle-type support, the invention could also be fabricated in a style that allows abdominal support along with the focused incision peri-pubic compression and scar management. In addition, the size of the garment is not limited.

The undergarment further includes an occlusive or semi-occlusive medicament dressing, or panel of scar management. For current techniques, silicone gel sheeting, a silica derived synthetic polymer, is often used, but other considered occlusive or semi-occlusive dressings appropriate to the invention include, but are not limited to; silicone gel, pads and fluids; elastomers (another silicone polymer); Duoderm™ or other moisture retaining/applying substances; silicone or other dressings and substances impregnated with wound healing adjuncts such as, but not limited to aloe, moisturizers or antibiotics; fabric coated with scar management mediums; foams or any other derived substances purported to assist in wound healing. Due to the easy minor modification of silicone and occlusive dressings, the inclusive list of clinically similar substances would be protracted. Varied thicknesses, densities and amounts of the scar management matter are inclusive of the invention. This variety allows for the customization of the product for the wearer and would be dependent on a list of variables including the size of the scar, the person's history of wound healing, the length of time since the procedure, the person's body habitus, the time of day (night versus day comfort), and the ambient temperature (lighter or heavier silicone layer) just to name a few.

Again considering the long scar remodeling phase of more than a year, the invention integrates a variety of scar management insertion techniques to allow for the wearer to customize the product. For a non-inclusive list of examples, the scar management material could be a detachable piece that affixes with Velcro, snaps, hooks etc into the "bikini area", it could be a patch covering the incision site that adheres to the skin applied under the undergarment compression or it could be sewn into the garment.

As the two scar management techniques of pressure and silicone placement have been used in conjunction as well as alone, in the invention styles where the scar management is removable, the undergarment with the peri-pubic panel could be worn separately and still address the maturing scar (although sub-optimally). As no undergarment has been found to be designed to address peri-pubic incision compression, the peri-pubic compression panel underpants are included as novel to this invention as a device to address the rehabilitation of the low transverse abdominal incision, the common cesarean approach.

BRIEF DESCRIPTION OF THE DRAWINGS

FIG. 1 is a perspective view of the present invention used in its typical clinical application.

FIG. 2 is a perspective front view of a typical undergarment fitted with the present invention therapeutic compression panel.

FIG. 3*a* is a perspective view of the present invention therapeutic compression panel, showing in more detail the physical components and orientation.

FIG. 3*b* is a perspective view of another embodiment of the present invention therapeutic panel whereby the undergarment material, elastomeric substrate and medicament are incorporated into a single composite structure.

FIG. 4 is a perspective view of a typical undergarment used in conjunction with an easily removable therapeutic and compression panel.

DESCRIPTION OF THE PREFERRED EMBODIMENTS

As shown in FIG. 1, the present invention shows a female individual 10 wearing the present invention in the lower abdomen area 12 that parallels typical women's undergarments. In accordance with the aspects of the present invention, FIG. 1 depicts an example undergarment 20 as worn by a female individual having a front side 23, and a back side, not shown. The undergarment 20 is adapted to fit the individual's body having a configuration with a torso opening 22 and a first and second leg opening 24*a*, 24*b*. The undergarment is modified to have a peri-pubic light therapeutic compression panel, designated generally as 30, allowing for compression and exposure to the medicament at the incision site. The undergarment is designed to be worn in lieu of regular underwear in everyday use.

As shown in more detail in FIG. 2, the therapeutic compression panel is somewhat trapezoidal in shape with curves to follow or mimic the shape of the individual's body having a front side 23, and a back side, not shown with torso opening 22 and a first and second leg opening 24*a*, 24*b*. The therapeutic compression panel (shown in more detail in FIGS. 3*a* and 3*b*) is designed to be attached either permanently or removably to the inside surface of the front side 23 of undergarment 20, whereby the medicament compression panel 30, 40 is in close proximity to the peri-pubic or lower transverse uterine area where the cesarean incision was made. FIG. 2 shows a general outline 26 where the therapeutic compression panel is located within undergarment 20. It is also anticipated that various other designs can be implemented to achieve the clinical benefits of the present invention. For example, the compression layer can be on the outside surface of the front side 23 or incorporated into the fabric of the undergarment 20. Then the medicament panel can be placed on the inside surface in close proximity to the peri-pubic or lower transverse area where the cesarean incision is located.

Depicted in FIG. 2 is an example undergarment in accordance with the present invention. However, the present invention undergarment 20 is not limited in style and can include, but is not limited to, fabricating as a bikini, thong, low-rise, support style, full or high cut undergarment. Considering the long phase of wound healing, this design flexibility allows for the use of the garment under a variety of street clothes. Unlike a girdle or abdominal support device, the crux of the invention does not require heavy abdominal support, although for those applications requiring girdle-type support, the invention could also be fabricated in a style that allows abdominal support along with the focused incision peri-pubic compression and scar management. In addition, the size of the garment is not limited.

Varied thicknesses, densities and amounts of the scar management matter are inclusive of the present invention. This variety allows for the customization of the product for the individual wearer and would be dependent on a list of variables including the size of the scar, the person's history of wound healing, the length of time since the procedure, the person's body habitus, the time of day (night versus day comfort), and the ambient temperature (lighter or heavier silicone layer)

Again considering the long scar remodeling phase of more than a year, the present invention integrates a variety of scar management insertion techniques to allow for the wearer to customize the product. For a non-inclusive list of examples, the scar management therapeutic compression panel 30, 40 is affixed to the inside surface of the front side 23 of the undergarment 20 utilizing a variety of techniques 28 including, but not limited to hook and loop technology (Velcro®), polymeric or metallic snaps, hooks, and adhesive or sewing technology. It could be a patch covering the incision site that adheres to the skin applied under the undergarment compression or it could be sewn into the garment.

Now referring to FIG. 3*a*, it can be seen that the therapeutic compression panel 30 is comprised of three components, a covering layer 32, a medicament layer 34 and a compression panel 36. The covering layer 32 is fabricated from a variety of materials commonly used for womens' undergarments, including, but not limited to, cotton, polyester, rayon, lycra, spandex, stretch cotton and polyester blends and other polymeric materials, and combinations thereof. The compression panel 36 is fabricated from general elastomeric materials such as lycra, spandex, elastic and elastic stitching, stretch cotton and polyesters, rubber materials, urethanes, silicones or other stretch based materials purported to provide stretch and compression. The medicament layer 34 can be silicone gel sheeting, a silica derived synthetic polymer. However, the Applicant also considers other occlusive or semi-occlusive dressings appropriate to the present invention which include, but are not limited to; silicone gel, pads and fluids; elastomers (another silicone polymer); Duoderm™ or other moisture retaining/applying substances; silicone or other dressings and substances impregnated with wound healing adjuncts such as, but not limited to aloe, moisturizers or antibiotics; fabric coated with scar management mediums; foams or any other derived substances purported to assist in wound healing. Due to the easy minor modification of silicone and occlusive dressings, the inclusive list of clinically similar substances would be protracted.

The layered therapeutic compression panel 30 is then generally placed on the inside surface of the front side 23 of the women's undergarment 20. It can be positioned within and secured to the inside surface in a number of methods. For example, it can be placed in a pocket that is securely attached to the undergarment. The pocket functions to allow replacement of the therapeutic compression panel at various periods to recharge the medicament or replace worn compression fabrics. The therapeutic compression panel can also be attached to the inside surface of the women's undergarment by means of hook and loop technology (Velcro®), polymeric or metallic snaps, and adhesive or sewing methodology.

Now referring to FIG. 3*b*, it can be seen that a composite therapeutic compression panel 40 is comprised of three previously mentions components, a covering layer 42, a medicament layer 44 and a compression panel 46. However, the three layers are formed as a single composite which incorporates the covering, compression layers and the medicament into a single substrate. As discussed the covering material 42 constructed from a variety of materials commonly used for womens' undergarments, including, but not limited to, cotton, polyester, rayon, lycra, spandex, stretch cotton and polyester blends and other polymeric materials, and combinations thereof. The compression material 46 is fabricated from general elastomeric materials such as lycra, spandex, elastic and elastic stitching, stretch cotton and polyesters, rubber materials, urethanes, siliconses or other stretch based materials purported to provide stretch and compression. The incorporated medicament layer 44 is typically silicone gel sheeting or a silica derived synthetic polymer. As previously discussed, the Applicant also considers other occlusive or semi-occlusive dressings appropriate to the present invention which include, but are not limited to; silicone gel, pads and fluids; elastomers (another silicone polymer); Duoderm™ or other moisture retaining/applying substances; silicone or other dressings and substances impregnated with wound healing adjuncts such as, but not limited to aloe, moisturizers or antibiotics; fabric coated with scar management mediums; foams or any other derived substances purported to assist in wound healing. Due to the easy minor modification of silicone and occlusive dressings, the inclusive list of clinically similar substances would be protracted.

The composite therapeutic and compression panel 40 is then positioned within and secured to the inside surface of the front side 23 of the present invention undergarment 20. It can be permanently or temporarily secured in a number of previously describe methods. For example, it can be placed in a pocket that is securely attached to the undergarment. The pocket functions to allow replacement of the therapeutic compression panel at various periods to recharge the medicament or replace worn compression fabrics. The therapeutic compression panel can also be attached to the inside surface of the women's undergarment by means of hook and loop technology (Velcro®), polymeric or metallic snaps, and adhesive or sewing methodology.

FIG. 4 is a perspective view of a typical undergarment used in conjunction with an easily removable therapeutic compression panel 50. In accordance with the aspects of the present invention, FIG. 4 depicts an example undergarment 20 as worn by an female individual 10 having a front side 23, a inside panel area 26 and a back side. The undergarment 20 is adapted to fit the individual's body having a configuration with a torso opening 22 and a first and second leg (not shown) opening 24*a*. The removable therapeutic compression panel 50 can be constructed from the layered therapeutic compression panel embodiment 30 or the composite therapeutic compression panel embodiment 40. The therapeutic compression panel 50 is removably attached to the inside surface of the women's undergarment by means of hook and loop technology (Velcro®), polymeric or metallic snaps, and adhesive or sewing methodology. The removably therapeutic and compression panel 50 is designed to function so that it can be used with various undergarments of the same design or of different designs.

As discussed previously the covering layer 32 or covering material 42 is constructed from a variety of materials commonly used for womens' undergarments, including, but not limited to, cotton, polyester, rayon, lycra, spandex, stretch cotton and polyester blends and other polymeric materials (please expand), and combinations thereof. The compression panel 36 or compression material 46 is fabricated from general elastomeric materials such as lycra, spandex, elastic and elastic stitching, stretch cotton and polyesters, rubber materials, urethanes, silicones or other stretch based materials purported to provide stretch and compression. The medicament layer 34 or incorporated medicament 44 can be silicone gel sheeting, a silica derived synthetic polymer, other occlusive or semi-occlusive dressings appropriate to the present invention which include, but are not limited to; silicone gel, pads and fluids; elastomers (another silicone polymer); Duoderm™ or other moisture retaining/applying substances; silicone or other dressings and substances impregnated with wound healing adjuncts such as, but not limited to aloe, moisturizers or antibiotics; fabric coated with scar management mediums; foams or any other derived substances purported to assist in wound healing. Due to the easy minor modification of silicone and occlusive dressings, the inclusive list of clinically similar substances would be protracted.

The invention claimed is:

1. A post-cesarean treatment undergarment for scar management, comprising:

a conforming support structure adapted to be worn around the pelvic area;

an elastic compression panel carried by a front side of said support structure so that a compression force is directed against and limited to the lower transverse uterine area; and, an occlusive dressing secured to said elastic compression panel on an interior surface of said front side of said support structure cooperating with said elastic compression panel so that said occlusive dressing stretches across the lower transverse uterine area together with said elastic compression panel and engages in direct contact with skin;

said occlusive dressing consisting of an exposed silicone medicament gel sheet, wherein said silicone medicament gel sheet physically interacts with the skin to retain moisture and maintain pressure to reduce scarring at a cesarean incision site.

2. The undergarment of claim 1 wherein said elastic compression panel is generally trapezoidal in shape to focus said compressive force across the lower transverse uterine area.

3. The undergarment of claim 1 wherein said silicone medicament gel sheet is localized within an area defined by said elastic compression panel.

4. A post-cesarean treatment undergarment for scar management, comprising:

a support structure adapted to be worn around the pelvic area;

an elastic compression panel carried by a front side of said support structure providing a localized compression force against and limited to the lower transverse uterine area; and, a silicone medicament gel sheet secured to said elastic compression panel stretching across the lower transverse uterine area in cooperation with said elastic compression panel providing an occlusive dressing engaging in direct contact with skin to retain moisture and maintain pressure against a localized area of a cesarean incision site to reduce scarring.

5. A post-cesarean treatment undergarment comprising:

a support structure adapted to be worn around the pelvic area; and, an elastic compression panel carried by a front side of said support structure providing a localized compression force against the lower transverse uterine area, wherein said elastic compression panel is impregnated with a silicone medicament gel in a composite arrangement so that said silicone medicament gel stretches with said elastic compression panel providing an occlusive dressing engaging in direct contact with skin to retain moisture and maintain pressure against a localized area of a cesarean incision site within the lower transverse uterine area to reduce scarring.

* * * * *